US009007354B2

(12) United States Patent
Park et al.

(10) Patent No.: US 9,007,354 B2
(45) Date of Patent: Apr. 14, 2015

(54) DISPLAY DEVICE AND METHOD FOR MANUFACTURING THE SAME

(75) Inventors: Joonha Park, Goyang-si (KR); Jaewoo Lee, Gumi-si (KR); Hyejin Kim, Goyang-si (KR); Juseong Park, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 392 days.

(21) Appl. No.: 13/183,908

(22) Filed: Jul. 15, 2011

(65) Prior Publication Data

US 2012/0013592 A1 Jan. 19, 2012

(30) Foreign Application Priority Data

Jul. 19, 2010 (KR) ..... 10-2010-0069707

(51) Int. Cl.

| | |
|---|---|
| ***G09G 5/00*** | (2006.01) |
| ***G09G 3/30*** | (2006.01) |
| ***G09G 3/36*** | (2006.01) |

(52) U.S. Cl.

CPC ..... *G09G 3/36* (2013.01)

(58) Field of Classification Search

None

See application file for complete search history.

(56) References Cited

U.S. PATENT DOCUMENTS

| | | | | |
|---|---|---|---|---|
| 6,473,065 | B1 * | 10/2002 | Fan | 345/82 |
| 2004/0085275 | A1 * | 5/2004 | Sugiyama et al. | 345/87 |
| 2006/0038267 | A1 * | 2/2006 | Cho | 257/678 |
| 2008/0036715 | A1 * | 2/2008 | Lee et al. | 345/87 |
| 2008/0225036 | A1 * | 9/2008 | Song et al. | 345/213 |
| 2010/0309236 | A1 * | 12/2010 | Min et al. | 345/691 |

FOREIGN PATENT DOCUMENTS

| | | | |
|---|---|---|---|
| TW | 200802265 | A | 1/2008 |

* cited by examiner

*Primary Examiner* — Christopher R Lamb

(74) *Attorney, Agent, or Firm* — McKenna Long & Aldridge LLP

(57) ABSTRACT

Provided is a display device including a panel, a driving circuit board connected to the panel, a driving unit mounted on the driving circuit board and driving the panel, a printed circuit board connected to the driving circuit board, and a memory unit mounted on the printed circuit board and storing calibration data for calibrating a data signal supplied to the panel.

9 Claims, 5 Drawing Sheets

DISPLAY DEVICE AND METHOD FOR MANUFACTURING THE SAME

This application claims the benefit of Korean Patent Application No. 10-2010-0069707 filed on Jul. 19, 2010, which is hereby incorporated by reference.

BACKGROUND

1. Field

The present invention relates to a display device and a method for manufacturing the same.

2. Related Art

With the development of multimedia, the importance of flat panel displays has recently been increased. Thus, various types of flat panel displays such as liquid crystal displays, plasma displays, and organic electroluminescence displays, and the like are in current use.

Among those display devices, some display devices, such as liquid crystal displays and organic electroluminescence displays, have used a method in which after a panel module is manufactured, the lighting state of a panel and the like is tested, and calibration data generated according to the state of the panel is stored in a memory unit mounted on a main board. The calibration data stored in the memory unit interworks with a timing driving unit mounted on the main board so as to calibrate a data signal to be supplied to the panel.

However, in the case of a panel module released without a main board, a memory unit storing calibration data is also omitted. Unlike this, in the case of a panel module with a main board, a client needs to execute the process of generating and storing calibration data. That is, since a memory unit storing calibration data is mounted on a main board in a related art panel module, it is difficult to cope with clients' various demands, and this needs to be solved.

SUMMARY

According to an aspect of the present invention, there is provided a display device, including: a panel; a driving circuit board connected to the panel; a driving unit mounted on the driving circuit board and driving the panel; a printed circuit board connected to the driving circuit board; and a memory unit mounted on the printed circuit board and storing calibration data for calibrating a data signal supplied to the panel.

According to another aspect of the present invention, there is provided a method for manufacturing a display panel, the method including: forming a panel; connecting a driving circuit board on which a driving unit is mounted to the panel; connecting a printed circuit board on which a memory unit is mounted to the driving circuit board; connecting a flexible printed circuit board to the printed circuit board; connecting a panel testing device to the flexible printed circuit board; and establishing data communication with the memory unit by using the panel testing device, and storing in the memory unit calibration data for calibrating a data signal supplied to the panel.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Reference will now be made in detail embodiments of the invention examples of which are illustrated in the accompanying drawings.

Figure 1:
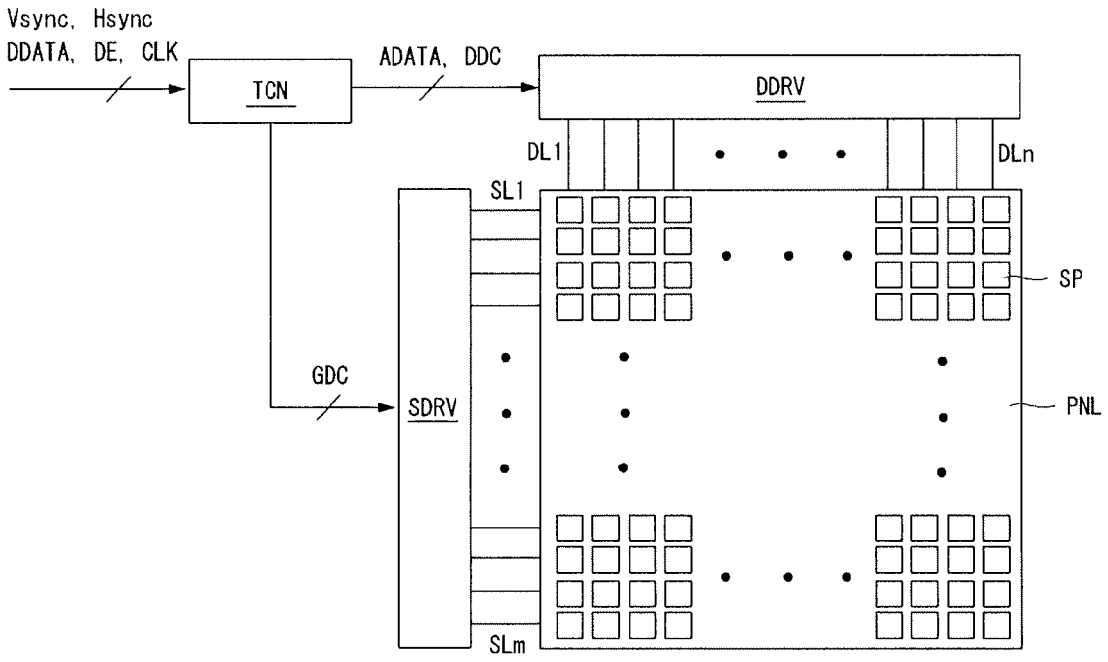
FIG. 1 is a schematic block diagram of a display device according to an exemplary embodiment of the present invention.
Figure 2:
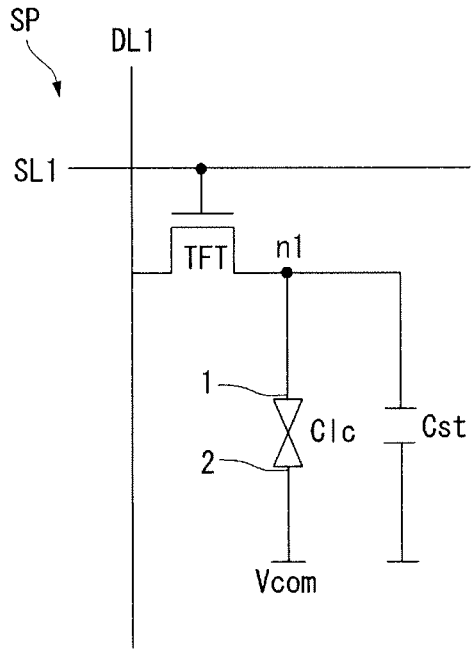
FIG. 2 is an exemplary view illustrating the configuration of a sub-pixel circuit of a liquid crystal display panel.
Figure 3:
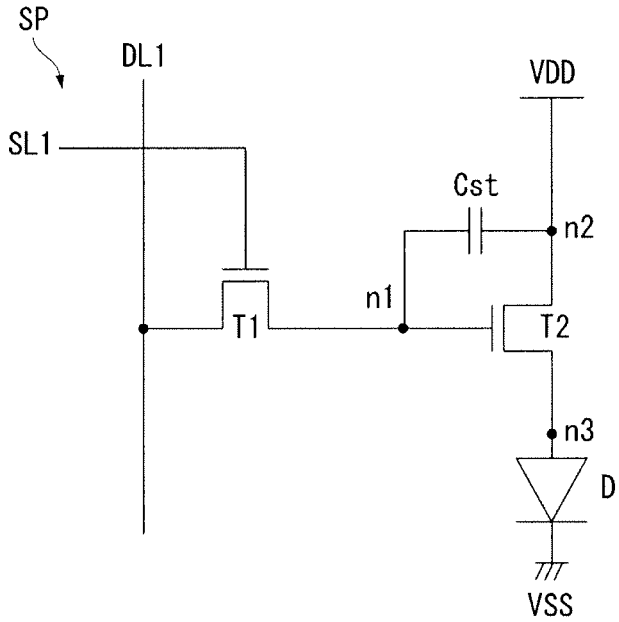
FIG. 3 is an exemplary view illustrating the configuration of a sub-pixel circuit of an organic electroluminescence display panel.

FIG. 1 is a schematic block diagram of a display device according to an exemplary embodiment of the present invention, FIG. 2 is an exemplary view illustrating the configuration of a sub-pixel circuit of a liquid crystal display panel, and FIG. 3 is an exemplary view illustrating the configuration of a sub-pixel circuit of an organic electroluminescence display panel.

As shown in FIG. 1, a display device according to an exemplary embodiment of the present invention includes a timing driving unit TCN, a gate driving unit SDRV, a data driving unit DDRV, and a panel PNL.

The timing driving unit TCN receives a vertical synchronous signal Vsync, a horizontal synchronous signal Hsync, a data enable signal DE, a clock signal CLK, and data signal DDATA from the outside. The timing driving unit TCN controls the operation timing of the data driving unit DDRV and the gate driving unit SDRV by using timing signals such as a vertical synchronous signal Vsync, a horizontal synchronous signal Hsync, a data enable signal DE, a clock signal CLK, and the like. Since the timing driving unit TCN can determine a frame period by counting the data enable signal DE of one horizontal period, the vertical synchronous signal Vsync and the horizontal synchronous signal Hsync supplied from the outside may be omitted. Control signals generated from the timing driving unit TCN may include a gate timing control signal GDC for controlling the operation timing of the gate driving unit SDRV, and a data timing control signal DDC for controlling the operation timing of the data driving unit DDRV. The gate timing control signal GDC includes a gate start pulse GSP, a gate shift clock GSC, a gate output enable signal GOE, and the like. The gate start pulse GSP is supplied to a gate drive integrated circuit IC where the first gate signal is generated. The gate shift clock GSC is a clock signal input in common to gate drive ICs for shifting the gate start pulse GSP. The gate output enable signal GOE controls the output of gate drive ICs. The data timing control signal DDC includes a source start pulse SSP, a source sampling clock SSC, a source output enable signal SOE, and the like. The source start pulse SSP controls the start point of the data sampling of the data driving unit DDRV. The source sampling clock SSC is a clock signal that controls data sampling in the data driving unit DDRV based on a rising or falling edge. The source output enable signal SOE controls the output of the data driving unit DDRV. Meanwhile, the source start pulse SS supplied to the data driving unit DDRV may be omitted according to a data transmission scheme.

The gate driving unit SDRV sequentially generates a gate signal while shifting the level of a signal to a swing width of gate driving voltage at which transistors of sub-pixels SP included in a panel PNL are operable, in response to the gate timing control signal GDC supplied from the timing driving unit TCN. The gate driving unit SDRV supplies the generated gate signal to the sub-pixels SP included in the panel PNL through gate lines SL1 to SLm. The gate driving unit SDRV may be formed directly in the panel PNL by a gate-in-panel GIP method or be formed outside the panel PNL.

The data driving unit DDRV performs sampling and latching upon a digital data signal DDATA supplied from the timing driving unit TCN in response to the data timing control signal DDC supplied from the timing driving unit TCN, thus converting it into data of a parallel data system. When converting the digital data signal into data of a parallel data system, the data driving unit DDRV converts the digital data signal DDATA into a gamma reference voltage, thus converting it into an analog data signal ADATA. The data driving unit DDRV supplies the converted data signal ADATA to the sub-pixels (SP) included in the panel PNL through data lines DL1 to DLn.

The panel PNL includes the sub-pixels SP arranged in the form of a matrix. The panel PNL may be configured as a liquid crystal display panel or an organic electroluminescence display panel. In a case where the panel PNL is configured as a liquid crystal display panel, the sub-pixel SP may have the following circuit configuration as shown FIG. 2. A switching transistor TFT has a gate connected to a gate line SL1 to which a gate signal is supplied, one end connected to a data line DL1 to which a data signal is supplied, and the other end connected to a first node n1. A pixel electrode 1 located at one side of a liquid crystal cell Clc has one end connected to the first node n1 connected to the other end of the switching transistor TFT, and a common electrode 2 located at the other side of the liquid crystal cell Clc is connected to a common voltage line Vcom. A storage capacitor Cst has one end connected to the first node, and the other end connected to the common voltage line Vcom. The liquid crystal display panel having such a sub-pixel SP structure may display an image by the transmission of light according to a change in a liquid crystal layer included in each sub-pixel according to a gate signal supplied through the gate line SL1 and a data signal supplied through the data line DL1.

Unlike the above, in a case where the panel PNL is configured as an organic electroluminescence display panel, the sub-pixel may have the following circuit configuration as shown in FIG. 3. A switching transistor T1 has a gate connected to a gate line SL1 to which a gate signal is supplied, one end connected to a data line DL1 to which a data signal is supplied, and the other end connected to a first node n1. A driving transistor T2 has a gate connected to the first node n1, one end connected to a second node n2 connected to a first power line VDD through which high-potential driving power Vdd is supplied, and the other end connected to a third node n3. A storage capacitor Cst has one end connected to the first node n1 and the other end connected to the second node n2. An organic light emitting diode D has an anode connected to the third node n3 connected to the other end of the driving transistor T2, and a cathode connected to a second power line VSS to which low-potential driving power Vss is supplied. The organic electroluminescence display panel having the above sub-pixel (SP) structure may display an image as a light emission layer included in each pixel emits light according to a gate signal supplied, through the gate line SL1 and a data signal supplied through the data line DL1.

Hereinafter, the configuration of a panel module of a display device according to an exemplary embodiment of the present invention will be described.

Figure 4:
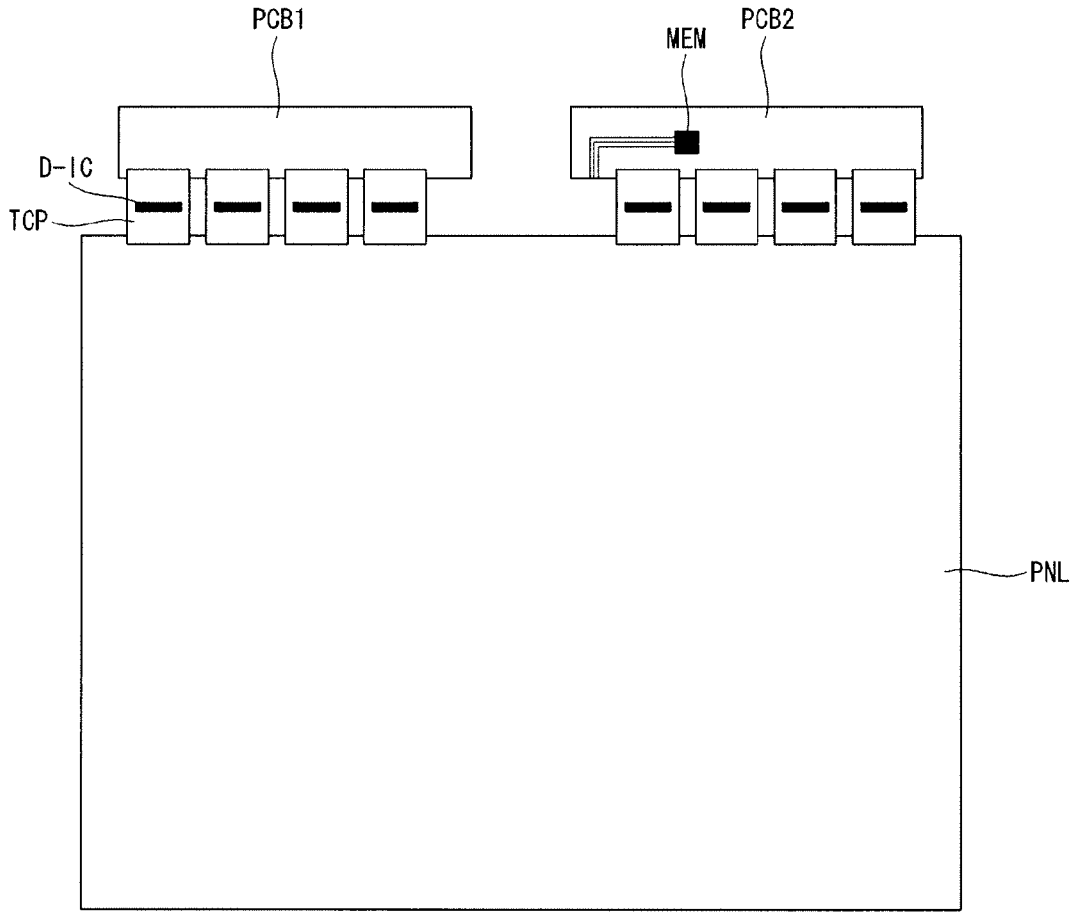
FIG. 4 is a view illustrating the configuration of a display module according to an exemplary embodiment of the present invention.
Figure 5:
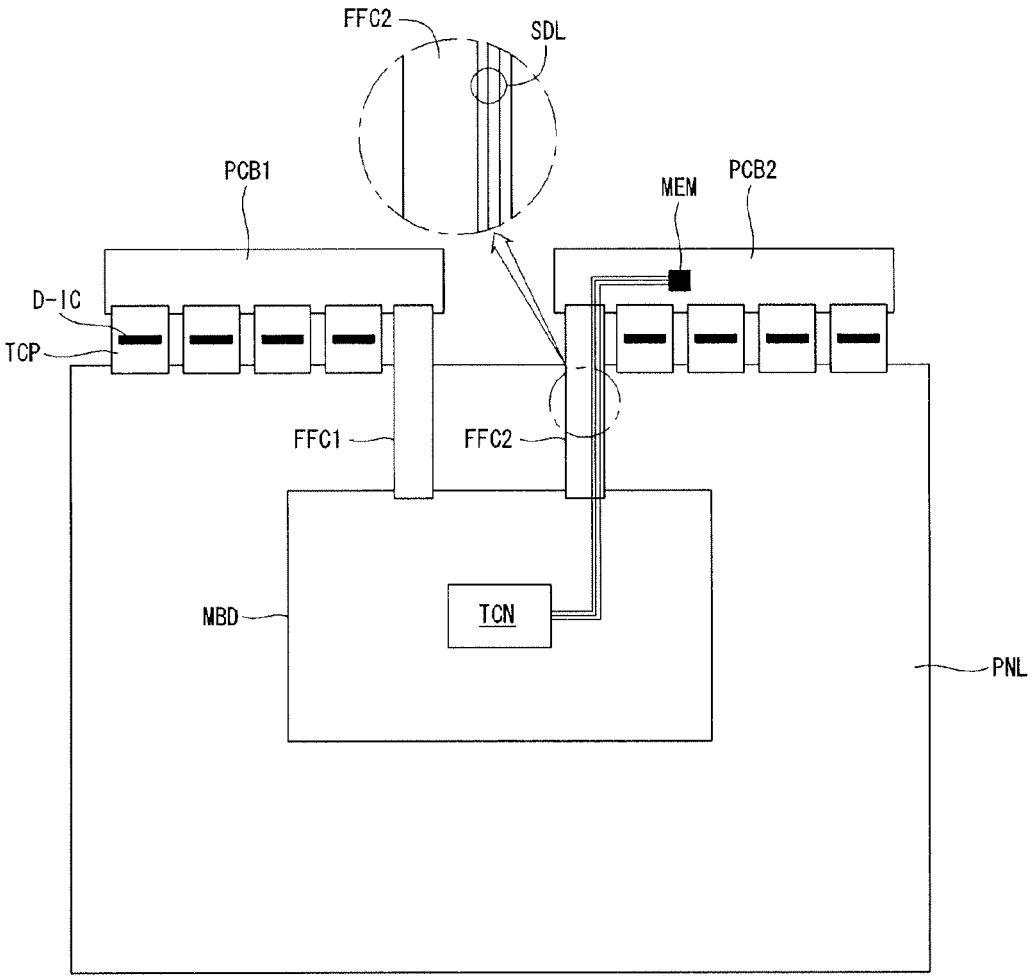
FIG. 5 is a view illustrating how a main board is connected to the panel module depicted in FIG. 4.

FIG. 4 is a view illustrating the configuration of a display module according to an exemplary embodiment of the present invention, and FIG. 5 is a view illustrating how a main board is connected to the panel module depicted in FIG. 4; and As shown in FIG. 4, a panel module of a display device according to an exemplary embodiment of the present invention includes a panel PNL, a driving circuit board TCP, printed circuit boards PCB1 and PCB2, and a memory unit MEM.

The panel PNL is formed as a liquid crystal display panel or an organic electroluminescence display panel as described above.

The driving circuit board TCP is electrically connected to a pad, formed on the panel PNL, by an anisotropic conductive layer or the like. A driving unit D-IC driving the panel PNL, for example, a data driving unit, is mounted on the driving circuit board TCP. A gate driving unit (not shown) may be directly formed in the panel PNL by a gate-in-panel (GIP) method. The driving circuit board TCP may be configured as a tape carrier package, but it is not limited thereto. Here, in the case of the driving circuit board TCP on which the driving unit D-IC is mounted, eight driving circuit boards TCP are illustrated by way of example, but the number of driving circuit boards TCP may be varied according to the size of the panel PNL.

The printed circuit boards PCB1 and PCB2 may be electrically connected to the driving circuit boards TCP by an anisotropic conductive layer or the like. The printed circuit boards PCB1 and PCB2 may be configured as printed circuit boards, but they are not limited to the description. The memory unit MEM storing calibration data for calibrating a data signal being supplied to the panel PNL is mounted on the second printed circuit board PCB2 of the printed circuit boards PCB1 and PCB2. The memory unit MEM may be mounted on the first printed circuit board PCB1. The memory unit MEM may include an electrically erasable programmable read-only memory (EEPROM) and a data communication module, but it is not limited thereto. However, the calibration data stored in the memory unit MEM is downloaded from a panel testing device through data communication between the panel testing device testing the panel PNL and the memory unit MEM. This will now be described in more detail.

The panel module of the display device configured in the above manner may be released prior to the attachment of a main board. Here, the memory unit MEM storing calibration data for compensating for a data signal supplied to the panel PNL is mounted on one of the printed circuit boards PCB1 and PCB2 included in the panel module. Accordingly, this allows for the application of a calibration technique to products where panel compensation were impossible due to the absence of main boards, thus ensuring proven display quality and leading to the release of products meeting clients' demand.

Meanwhile, as shown in FIG. 5, flexible printed circuit boards FFC1 and FFC2 are respectively connected to the printed circuit boards PCB1 and PCB2 included in the panel module. The printed circuit boards PCB1 and PCB2 and the flexible printed circuit boards FFC1 and FFC2 may be electrically connected by an anisotropic conductive layer or the like. The flexible printed circuit boards FFC1 and FFC2 may be configured as flexible flat cables, but they are limited thereto.

A main board MBD on which a timing driving unit TCN for controlling the driving unit D-IC is mounted is connected to the flexible printed circuit boards FFC1 and FFC2. The timing driving unit TCN controls the data driving unit, the driving unit D-IC, the gate driving unit formed on the panel PNL, and the like. Also, the timing driving unit TCN may establish data communication with the memory unit MEM through signal lines SDL formed at the second printed circuit board PCB2, the second flexible printed circuit board FFC2 and the main board MBD. The timing driving unit TCN receives calibration data from the memory unit MEM through data communication with the memory unit MEM, and calibrates a data signal to be supplied to the data driving unit, the driving unit D-IC, based on the received calibration data. A serial communication scheme may be selected as a scheme for the data communication between the timing driving unit TCN and the memory unit MEM, but the data communication scheme is not limited thereto. For example, a data communication module included in the memory unit MEM may perform data communication with the timing driving unit TCN according to an I2C serial communication scheme. In this case, the number of signal lines SDL formed at the second printed circuit board PCB2, the second flexible printed circuit board FFC2 and the main board MBD is at least three. At this time, the at least three signal lines SDL include a data signal line SDA, a clock signal line SCL, and a light-protected signal line WP. Meanwhile, the signal lines SDL may utilize the dummy lines of the main board MBD, the second flexible printed circuit board FFC2 and the second printed circuit board PCB2, but they are not limited thereto.

Due to the above construction, in a case of a released panel module, a client needs to perform only the process of connecting the main board MBD and the flexible printed circuit boards FFC1 and FFC2 where the signal lines SDL are formed. Thus, a separate additional process, caused by the formation of the memory unit MEM storing calibration data, is not demanded.

Hereinafter, a method for manufacturing a display device according to an exemplary embodiment of the present invention will be described.

Figure 6:
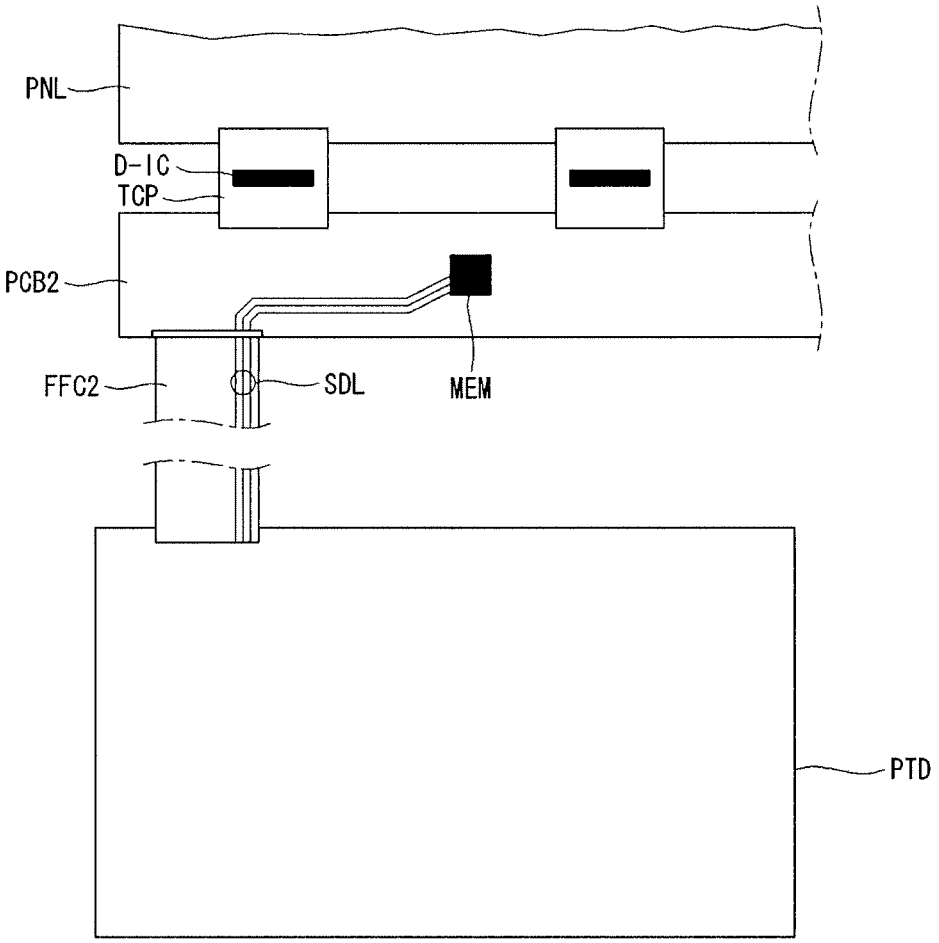
FIG. 6 is a view for explaining the generation and storage of calibration data using a panel testing device in a method for manufacturing a display device according to an exemplary embodiment of the present invention.

FIG. 6 is a view for explaining the generation and storage of calibration data using a panel testing device in the method for manufacturing a display device according to an exemplary embodiment of the present invention.

The method for manufacturing a display device according to an exemplary embodiment of the present invention will be described with reference to FIGS. 1 to 5 and FIG. 6.

First, a panel PNL is formed. The panel PNL is formed as a liquid crystal display panel or an organic electroluminescence display panel.

Thereafter, a driving circuit board TCP on which a driving unit D-IC is mounted is connected to the panel PNL. The driving circuit board TCP may be configured as a tape carrier package, but it is not limited thereto. For the connection between the driving circuit board TCP and the panel PNL, an anisotropic conductive layer may be used, but it is not limited thereto.

Subsequently, printed circuit boards PCB1 and PCB2 on which a memory unit MEM is mounted are connected to the driving circuit board TCP. The printed circuit boards PTB1 and PCB2 may be configured as printed circuit boards, but they are not limited thereto. The memory unit MEM may include an EEPROM, which is a non-volatile memory, and a data communication module, but the memory unit MEM is not limited thereto.

Thereafter, flexible printed circuit boards FFC1 and FFC2 are connected to the printed circuit boards PCB1 and PCB2. The flexible printed circuit boards FFC1 and FFC2 may be configured as flexible flat cables, but they are not limited thereto.

Next, a panel testing device PTD is connected to the flexible printed circuit boards FFC1 and FFC2. For ease of description, in FIG. 6, a part of the panel testing device PTD is connected to the second flexible printed circuit board FFC2.

Subsequently, data communication with the memory unit MEM is established by using the panel testing device PTD, and calibration data for calibrating a data signal supplied to the panel PNL is stored in the memory unit MEM. The process of storing calibration data may be carried out in the order of the process of testing a state of the panel PNL with the panel testing device PTD, the process of generating calibration data according to the state of the panel PNL by using the panel testing device PTD, and the process of establishing data communication with the memory unit MEM by using the panel testing device PTD and thus storing in the memory unit MEM calibration data for calibrating a data signal supplied to the panel PNL, but the order is not limited to the description.

As for the panel testing device PTD used in the exemplary embodiment, any device may be used provided that it can supply a test signal or the like to the panel PNL, generate calibration data according to a state of the panel PNL by the test signal or the like, and allows the memory unit MEM to download the generated calibration data by a data communication scheme.

Meanwhile, after the calibration data is stored in the memory unit MEM, the panel testing device PTD is separated from the flexible printed circuit boards FFC1 and FFC2, and the main board MBD on which a timing driving unit TCN is mounted is connected to the flexible printed circuit boards FFC1 and FFC2.

The display device manufactured as described above is applicable to a television, a monitor, and a mobile device, and of course, a three-dimensional display device or the like.

According to an exemplary embodiment of the present invention, there are provided the display device and a method for manufacturing the same, in which a memory unit storing calibration data is mounted on a printed circuit board included in a panel module so as to render a product, which could not be subjected to calibration for display quality of a panel due to the absence of a main board, applicable to a calibration technique. Furthermore, the embodiment of the present invention can ensure proven display quality and allowing for the release of a product meeting a client's demand.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A display device, comprising:

a panel;

a driving circuit board connected to the panel;

a driving unit mounted on the driving circuit board and driving the panel;

a printed circuit board connected to the driving circuit board; and a memory unit mounted on the printed circuit board that is separate from the driving circuit board, wherein the memory unit stores calibration data for calibrating a data signal supplied to the panel;

a flexible printed circuit board having a first end connected to the printed circuit board;

a main board connected to a second end of the flexible circuit board; and a timing driving unit mounted on the main board and controlling the driving unit, wherein the timing driving unit receives the calibration data through data communication with the memory unit and calibrates the data signal, which is to be supplied to the driving unit, based on the calibration data, and wherein the calibration data is generated using a panel testing device according to a state of the panel.

2. The display device of claim 1, wherein the data communication between the timing driving unit and the memory unit is carried out by signal lines formed at the printed circuit board, the flexible printed circuit board, and the main board.

3. The display device of claim 2, wherein a scheme for the data communication between the timing driving unit and the memory unit comprises a serial communication scheme.

4. The display device of claim 2, wherein the number of signal lines is at least three.

5. The display device of claim 1, wherein the calibration data is downloaded from the panel testing device for testing the panel, through data communication between the memory unit and the panel testing device.

6. The display device of claim 1, wherein the panel is one of a liquid crystal display panel and an organic electroluminescence display panel.

7. A method for manufacturing a display panel, the method comprising:

forming a panel;

connecting a driving circuit board on which a driving unit is mounted to the panel;

connecting a printed circuit board on which a memory unit is mounted to the driving circuit board;

connecting a first side of a flexible printed circuit board to the printed circuit board;

connecting a panel testing device to a second side of the flexible printed circuit board; and establishing data communication with the memory unit, configured on the printed circuit board that is separate from the driving circuit board, by using the panel testing device, and storing in the memory unit calibration data for calibrating a data signal supplied to the panel, wherein the calibration data is generated using the panel testing device according to a state of the panel.

8. The method of claim 7, wherein the storing of the calibration data comprises:

testing a state of the panel by using the panel testing device; and generating the calibration data according to the state of the panel by using the panel testing device.

9. The method of claim 7, further comprising, after the storing of the calibration data in the memory unit, separating the panel testing device from the flexible printed circuit board; and connecting a main board on which a timing driving unit is mounted to the second side of the flexible printed circuit board.

* * * * *